US010722744B2

(12) United States Patent
Sun

(10) Patent No.: US 10,722,744 B2
(45) Date of Patent: Jul. 28, 2020

(54) TRAMPOLINE WITH ADJUSTABLE ELASTICITY

(71) Applicant: YANGZHOU KANGLE MACHINERY CO., LTD., Yangzhou, Jiangsu (CN)

(72) Inventor: Bisheng Sun, Yangzhou (CN)

(73) Assignee: YANGZHOU KANGLE MACHINERY CO., LTD., Yangzhou (CN)

( * ) Notice: Subject to any disclaimer, the term of this patent is extended or adjusted under 35 U.S.C. 154(b) by 34 days.

(21) Appl. No.: 15/776,952

(22) PCT Filed: Aug. 30, 2017

(86) PCT No.: PCT/CN2017/099570
§ 371 (c)(1),
(2) Date: May 17, 2018

(87) PCT Pub. No.: WO2019/037141
PCT Pub. Date: Feb. 28, 2019

(65) Prior Publication Data

US 2019/0151695 A1 May 23, 2019

(30) Foreign Application Priority Data

Aug. 25, 2017 (CN) ..... 2017 1 0742432

(51) Int. Cl.
*A63B 5/11* (2006.01)
*A63B 21/078* (2006.01)
*A63B 21/072* (2006.01)
*A63B 23/04* (2006.01)
*A63B 21/00* (2006.01)

(52) U.S. Cl.
CPC ..... *A63B 5/11* (2013.01); *A63B 21/078* (2013.01); *A63B 21/00069* (2013.01); *A63B 21/0724* (2013.01); *A63B 2023/0411* (2013.01); *A63B 2225/093* (2013.01)

(58) Field of Classification Search
CPC ..... A63B 5/11; A63B 9/00; A63B 2009/006; Y10T 403/34; Y10T 403/341; Y10T 403/44; Y10T 403/42; Y10T 403/73; Y10T 403/4602; F16B 7/044; F16B 7/048; F16B 7/0486; F16B 12/44; F16B 2012/443; F16B 2012/446; F16B 12/50; F16B 12/40
See application file for complete search history.

(56) References Cited

U.S. PATENT DOCUMENTS

2017/0239503 A1* 8/2017 Goldwitz ..... E04H 15/006

* cited by examiner

*Primary Examiner* — Jennifer Robertson
(74) *Attorney, Agent, or Firm* — Oliff PLC

(57) ABSTRACT

The present invention relates to a trampoline with adjustable elasticity. The trampoline includes several corresponding trampoline ring parts, and adjacent trampoline ring parts are connected through a joint to form the trampoline; and an arc length between the adjacent trampoline ring parts changes through adjustment of the joint, and is fixed after relative positions of the two adjacent trampoline ring parts are properly adjusted. The elasticity of the trampoline of the present invention is adjustable, thereby providing a user with an exercise experience of a variety of elasticity.

6 Claims, 20 Drawing Sheets

TRAMPOLINE WITH ADJUSTABLE ELASTICITY

BACKGROUND

Technical Field

The present invention relates to a trampoline with adjustable elasticity.

Related Art

Currently, in a known trampoline, elasticity of trampoline fabric is unchangeable.

SUMMARY

To provide a user with an exercise experience of a variety of elasticity, the present invention provides a technical solution that implements adjustable elasticity of a trampoline.

The technical solution used in the present invention is that the present invention includes several corresponding trampoline ring parts, and adjacent trampoline ring parts are connected through a joint to form the trampoline; and an arc length between the adjacent trampoline ring parts changes through adjustment of the joint, and is fixed after relative positions of the two adjacent trampoline ring parts are properly adjusted.

The joint is T-shaped, and includes a column and a connecting tube that connects the adjacent trampoline ring parts;

a through hole for a connecting rod to pass through is provided on the column in a transverse direction, and positioning parts that are located on two sides of the through hole and position the connecting rod are provided on the connecting rod; and joint end portions of the adjacent trampoline ring parts extend downwardly to form connecting bases corresponding to the connecting rod, a connecting hole for the connecting rod to pass through is provided on each connecting base, and a position of the connecting rod on the connecting hole is adjustable and fixed.

Each positioning part has a structural form of a knob, and the positioning part is screwed into the connecting rod, and implements positioning of the connecting rod by using a threaded hole that is provided on the connecting rod and a cross bolt that passes through the knob positioning part.

Negatively provided external threads are provided at two ends of the connecting rod, and corresponding internal threads are provided at the connecting holes of the connecting bases.

Another structural form is that the joint includes a connecting tube corresponding to the trampoline ring parts, and check rings are sleeved over the connecting tube and are positioned by a stepped surface formed on the connecting tube, to change a depth at which the connecting tube enters the trampoline ring parts.

The joint has a pseudo-elliptical shape, a triangular shape, a quadrangular shape, a pentagonal shape, and a hexagonal shape, and each check ring correspondingly has a pseudo-elliptical shape, a triangular shape, a quadrangular shape, a pentagonal shape, and a hexagonal shape.

An outer edge of the check ring has a circular shape that is consistent with a circular shape of a cross section of the trampoline ring part.

An advantage of the present invention is that the elasticity of the trampoline is adjustable, thereby providing a user with an exercise experience of a variety of elasticity.

Figure 1:
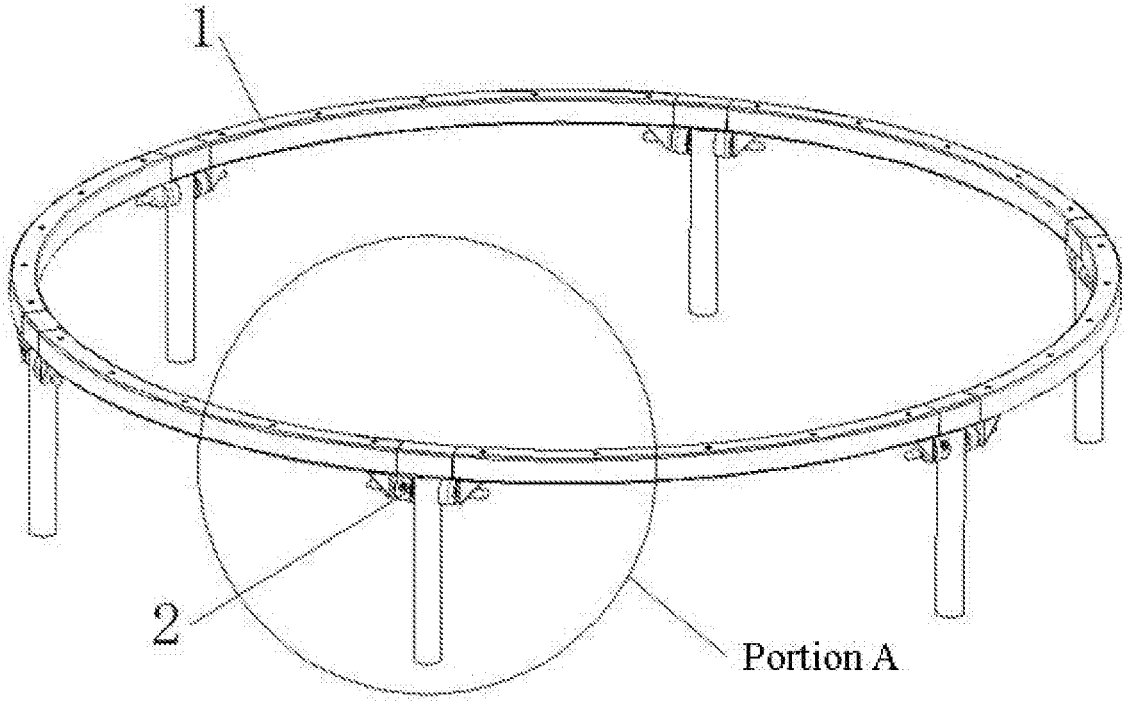
FIG. 1 is a schematic structural diagram showing that trampoline ring parts in one structural form are assembled according to the present invention.
Figure 2:
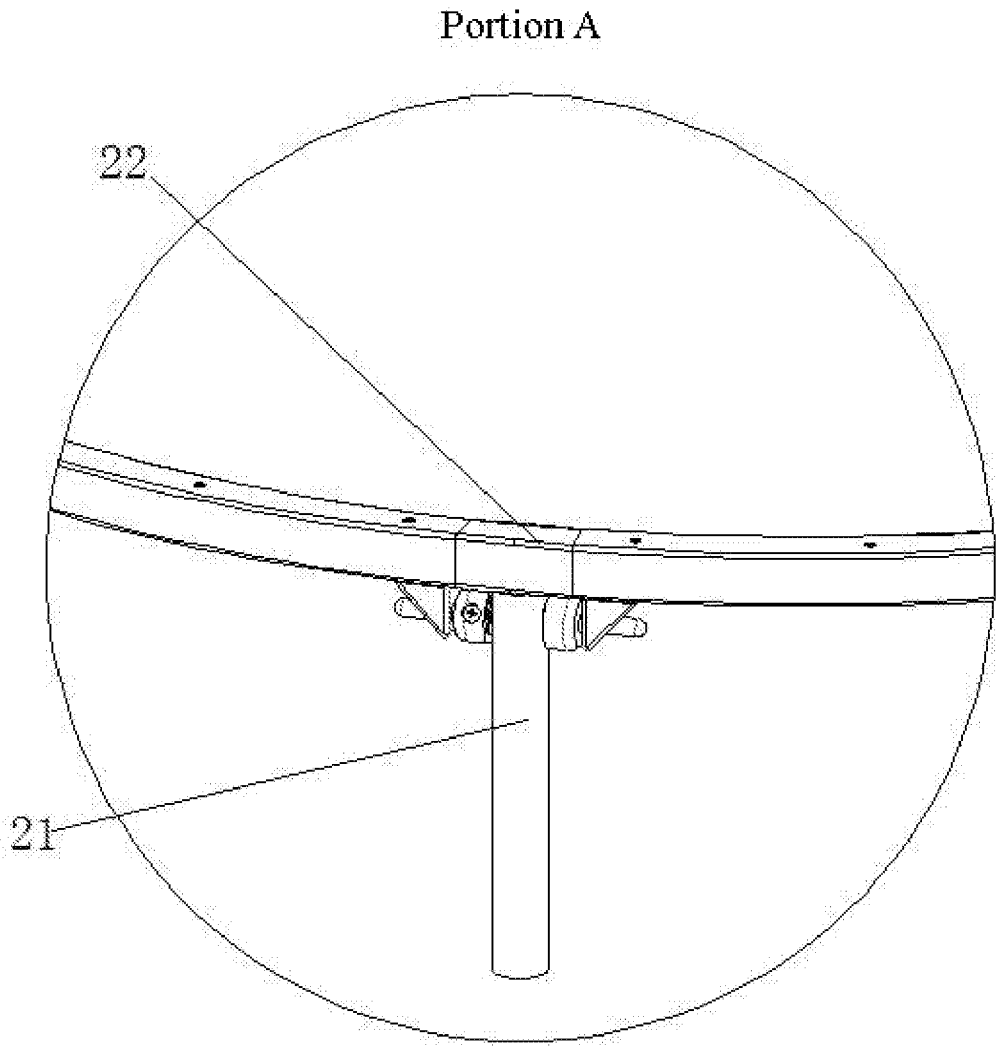
FIG. 2 is an enlarged view of a portion A in FIG. 1.
Figure 3:
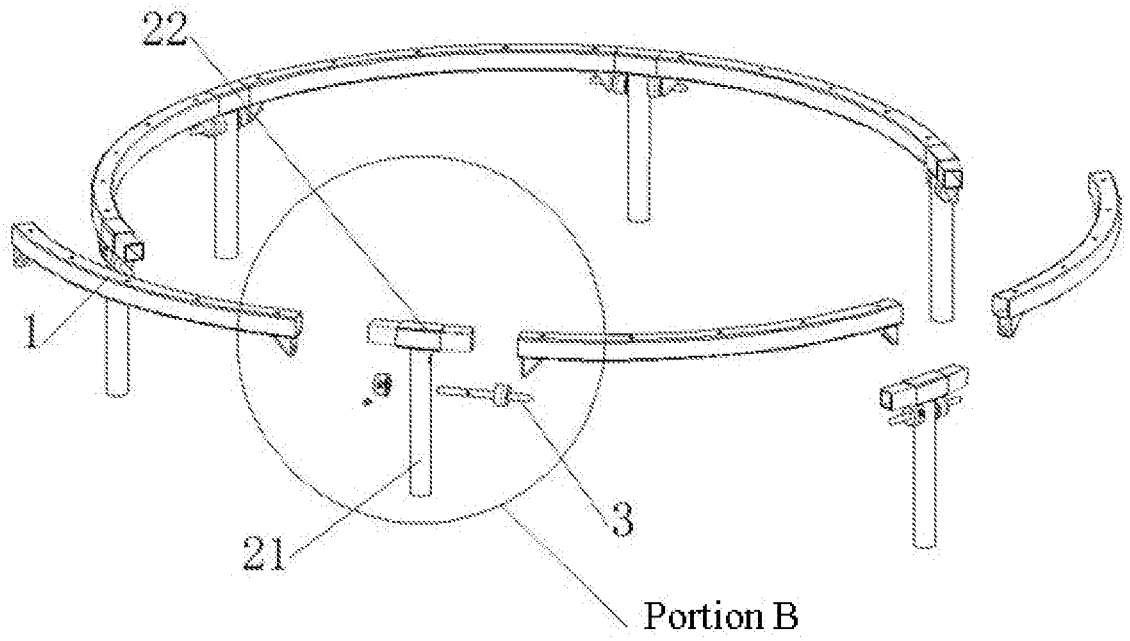
FIG. 3 is a schematic structural diagram when trampoline ring parts of the present invention are disassembled.
Figure 4:
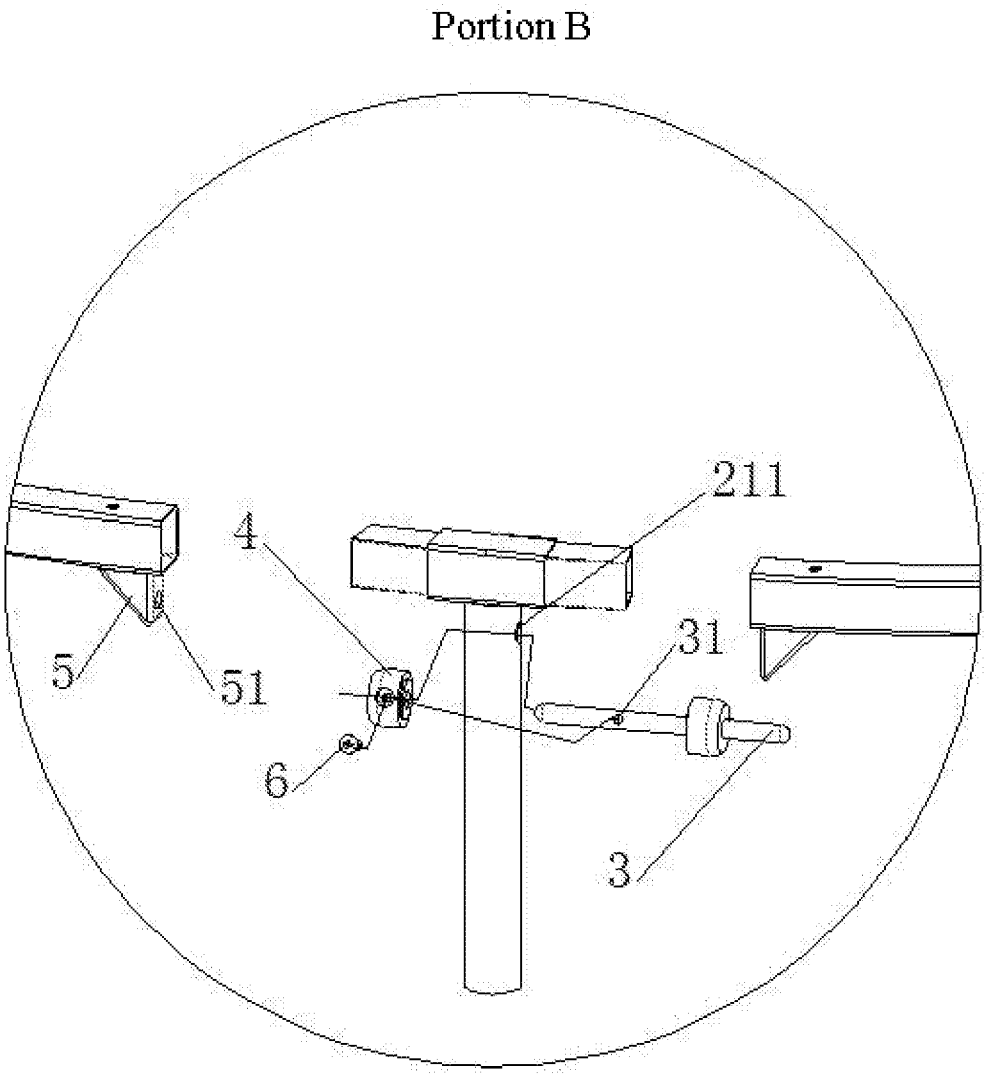
FIG. 4 is an enlarged view of a portion B in FIG. 3.
Figure 5:
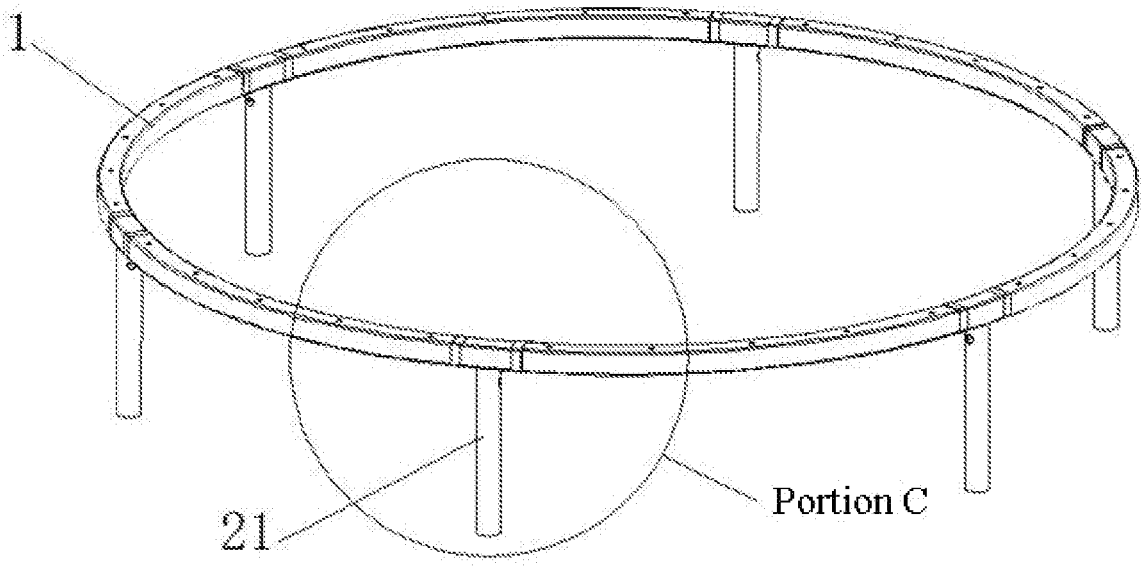
FIG. 5 is a schematic structural diagram showing that trampoline ring parts in another structural form are assembled according to the present invention.
Figure 6:
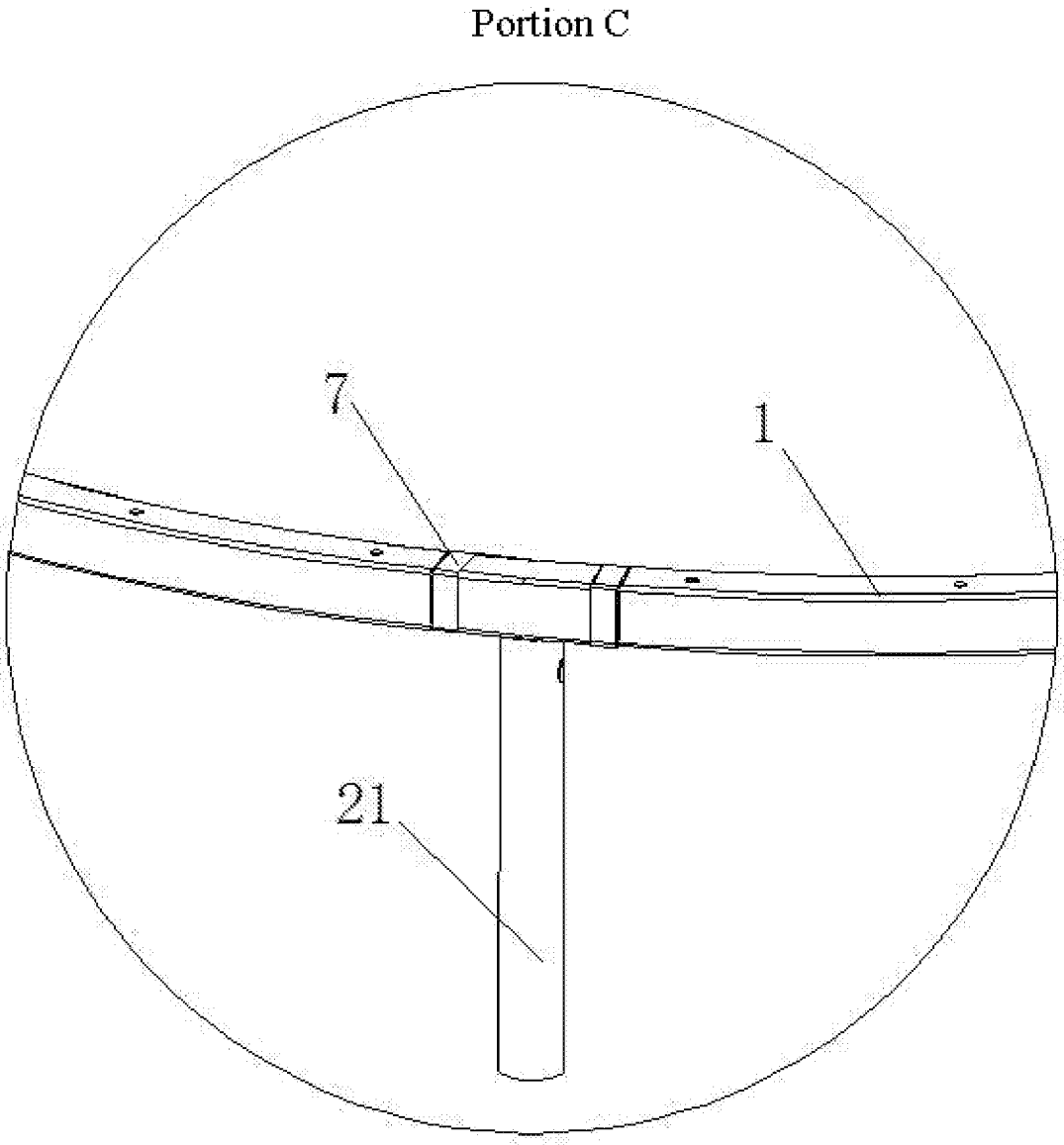
FIG. 6 is an enlarged view of a portion C in FIG. 5.
Figure 7:
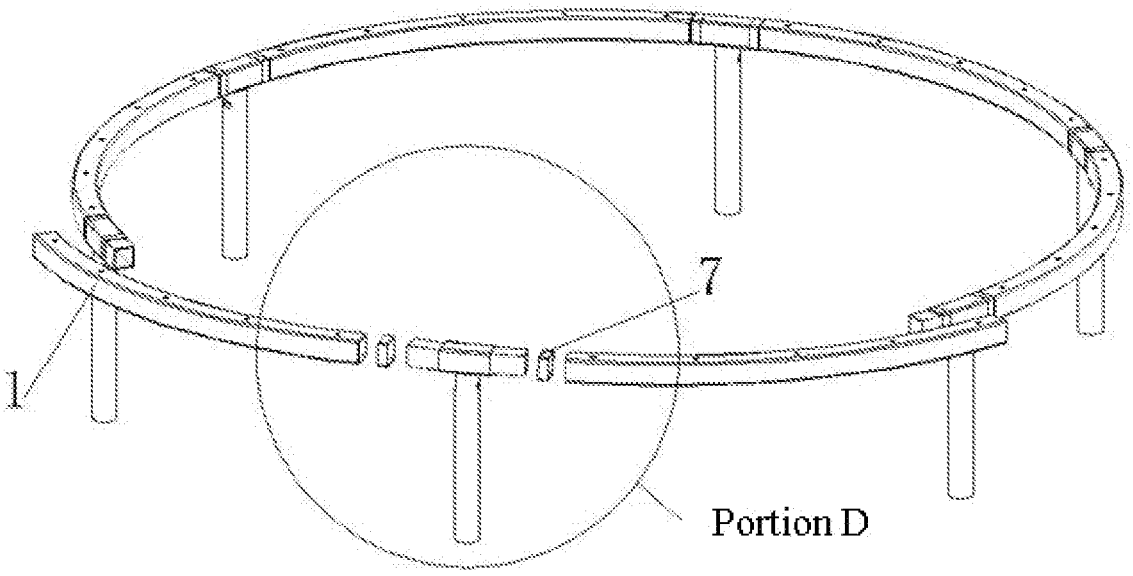
FIG. 7 is a schematic structural diagram when trampoline ring parts of the present invention are disassembled.
Figure 8:
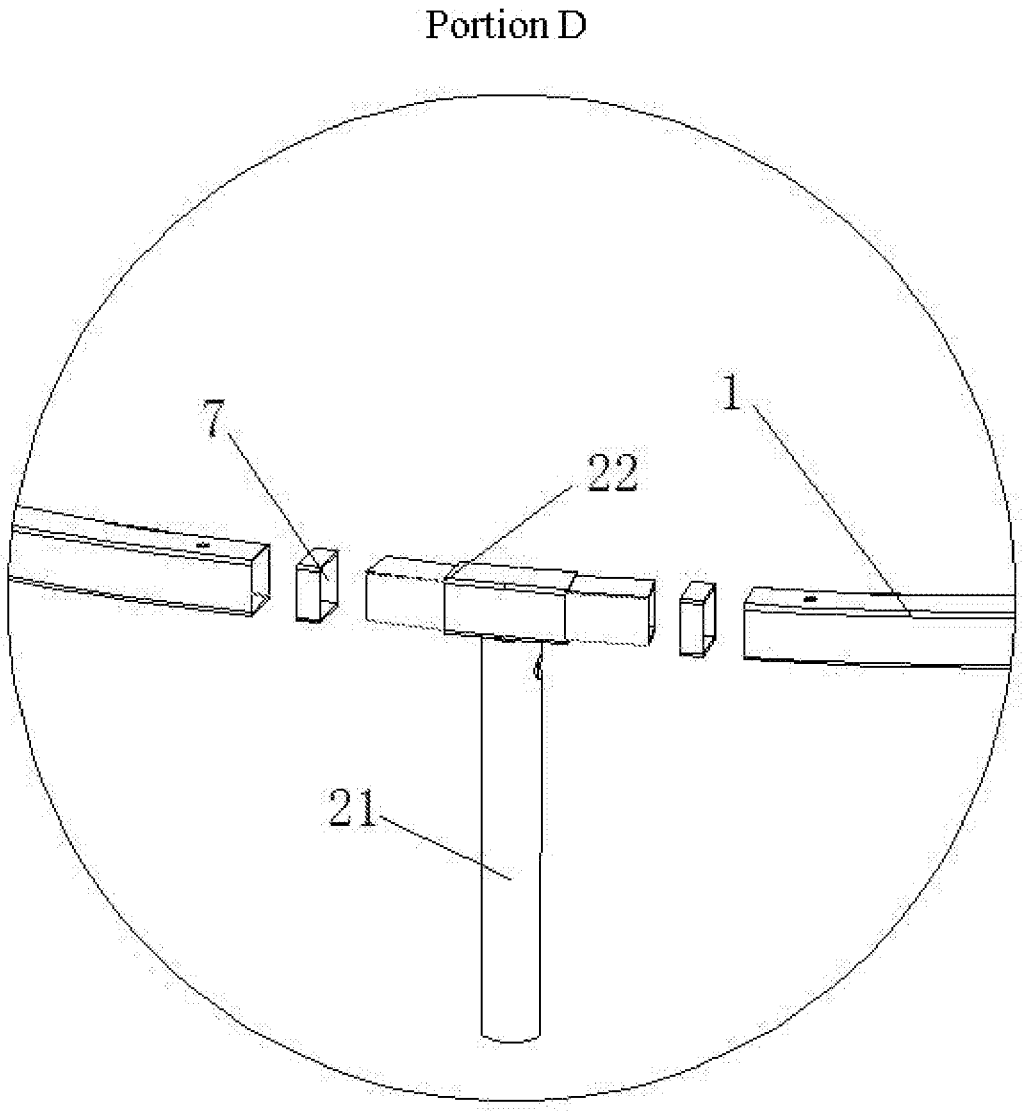
FIG. 8 is an enlarged view of a portion D in FIG. 7.
Figure 9:
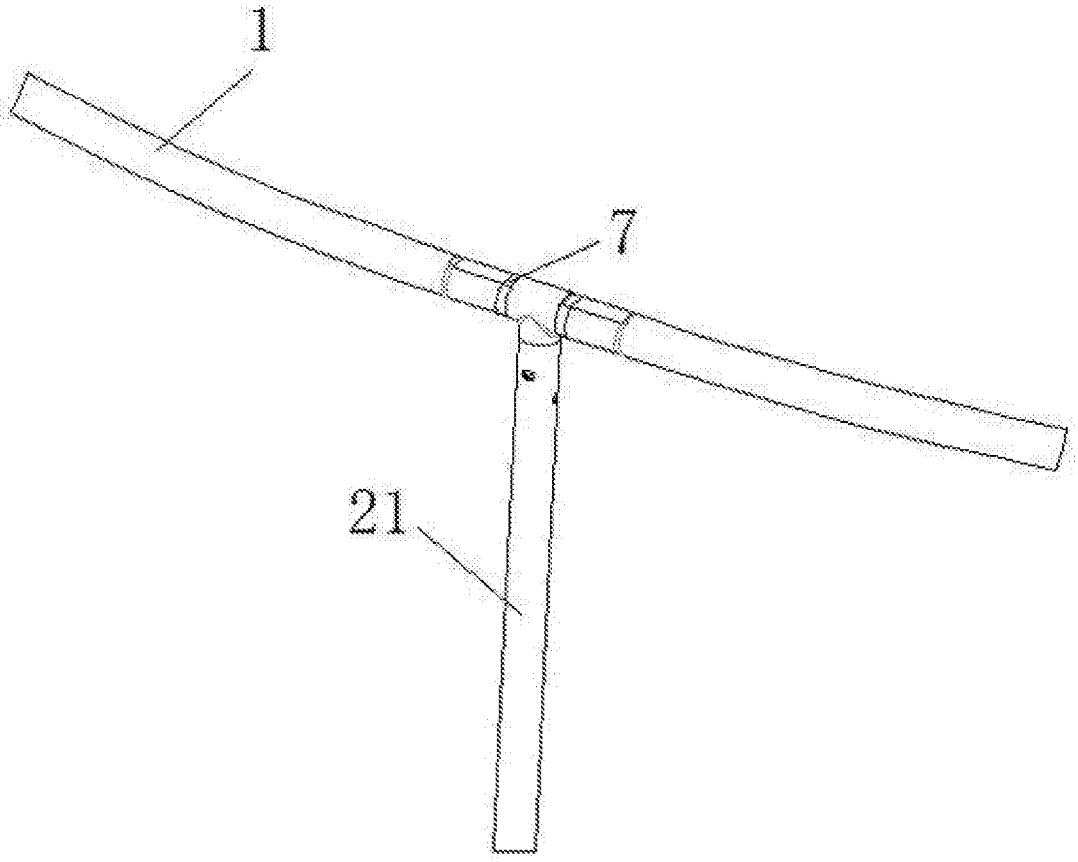
FIG. 9 is a schematic structural diagram when circular pipes are assembled.
Figure 10:
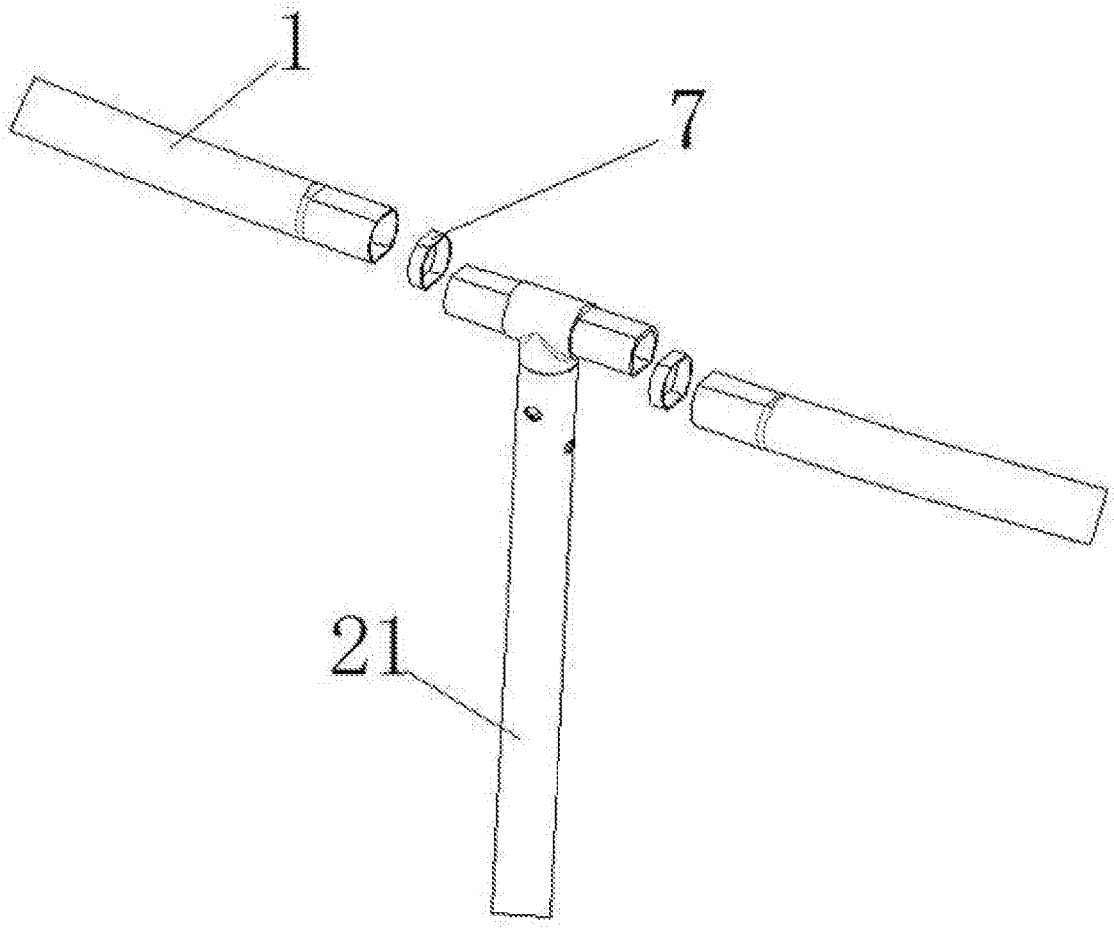
FIG. 10 is a schematic structural diagram when trampoline ring parts being circular pipes are disassembled.
Figure 11:
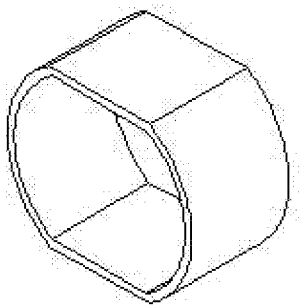
FIG. 11 to FIG. 20 are sectional views of check rings in different structural forms of the present invention.
Figure 12:
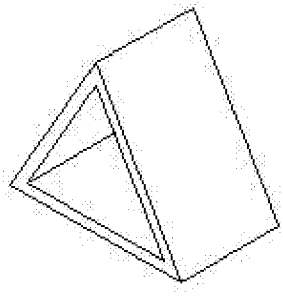
Figure 13:
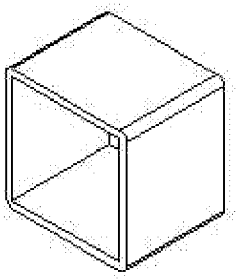
Figure 14:
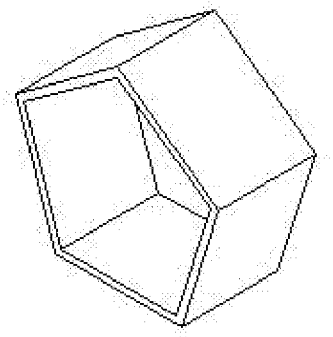
Figure 15:
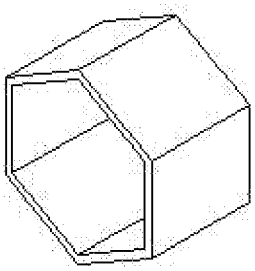
Figure 16:
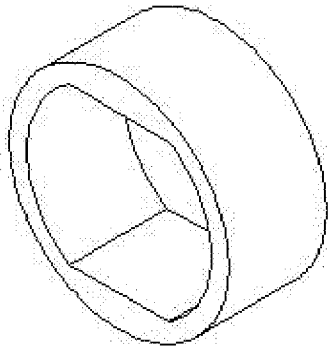
Figure 17:
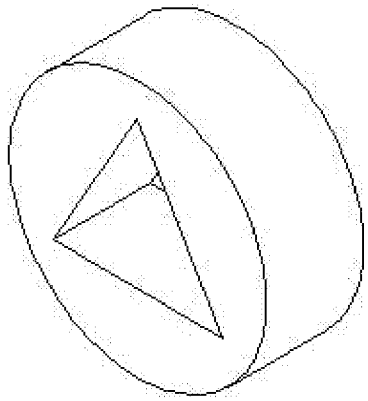
Figure 18:
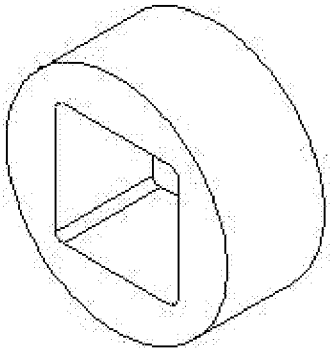
Figure 19:
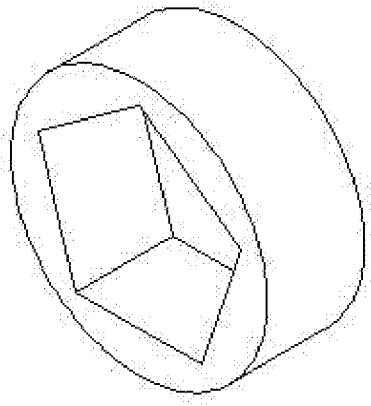
Figure 20:
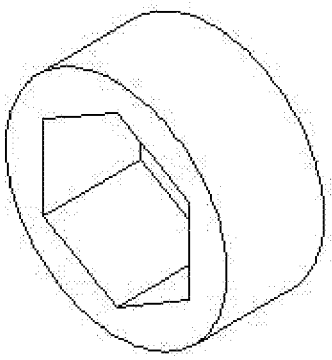

In the drawings, 1 represents a trampoline ring part, 2 represents a joint, 3 represents a connecting rod, 4 represents a positioning part, 5 represents a connecting base, 6 represents a cross bolt, and 7 represents a check ring;

21 represents a column, 22 represents a connecting tube, 31 represents a threaded hole, and 51 represents a connecting hole; and

211 represents a through hole.

DETAILED DESCRIPTION

Embodiment 1

The present invention includes several corresponding trampoline ring parts 1, and adjacent trampoline ring parts 1 are connected through a joint 2 to form the trampoline.

An arc length between the adjacent trampoline ring parts 1 changes through adjustment of the joint 2, and is fixed after relative positions of the two adjacent trampoline ring parts 1 are properly adjusted.

The joint 2 is T-shaped, and includes a column 21 and a connecting tube 22 that connects the adjacent trampoline ring parts 1;

a through hole 211 for a connecting rod 3 to pass through is provided on the column 21 in a transverse direction, and positioning parts 4 that are located on two sides of the through hole 211 and position the connecting rod 3 are provided on the connecting rod 3; and joint end portions of the adjacent trampoline ring parts 1 extend downwardly to form connecting bases 5 corresponding to the connecting rod 3, a connecting hole 51 for the connecting rod 3 to pass through is provided on each connecting base 5, and a position of the connecting rod 3 on the connecting hole 51 is adjustable and fixed.

Each positioning part 4 has a structural form of a knob, and the positioning part 4 is screwed into the connecting rod 3, and implements positioning of the connecting rod 3 by using a threaded hole 31 that is provided on the connecting rod 3 and a cross bolt 6 that passes through the knob positioning part 4.

Negatively provided external threads are provided at two ends of the connecting rod 3, and corresponding internal threads are provided at the connecting holes of the connecting bases 5.

An adjustment process of the present invention is that the trampoline ring parts 1 are in a multi-section sleeve structure and include six sections, and the trampoline ring parts 1 are sleeved together through six corresponding joints 2 to form the trampoline. The connecting rod 3 is inserted into the through hole 211 of the column 21, and is then inserted into a connecting hole 51 on a left side. A threaded hole 31 is provided at a shaft of the connecting rod 3, and each knob positioning part 4 is fixed on the connecting rod 3 through a cross bolt 6. Nuts are provided on the connecting bases 5. A positive nut on a left side has positive threads, and a negative nut on a right side has negative threads. On the shaft of the connecting rod 3, positive threads are provided on a left side and negative threads are on provided a right side, and the threads on the left side and the right side are respectively screwed into corresponding nuts.

Embodiment 2

The present invention includes several corresponding trampoline ring parts 1, and adjacent trampoline ring parts 1 are connected through a joint 2 to form the trampoline.

An arc length between the adjacent trampoline ring parts 1 changes through adjustment of the joint 2, and is fixed after relative positions of the two adjacent trampoline ring parts 1 are properly adjusted.

The joint 2 includes a connecting tube 22 corresponding to the trampoline ring parts 1, and check rings 7 are sleeved over the connecting tube 22 and are positioned by a stepped surface formed on the connecting tube 22, to change a depth at which the connecting tube 22 enters the trampoline ring parts 1.

An adjustment process of the present invention is that the trampoline has a multi-section sleeve structure and includes six sections, and the trampoline ring parts 1 are sleeved together through six corresponding joints 2. The check rings 7 are selectively disposed at the six joints 2 to change the size of a trampoline ring. If no check ring 7 is disposed, the size of the trampoline ring is minimal. The size of the trampoline, the tightness of trampoline fabric, and elasticity are adjusted by changing a quantity of used check rings 7 or changing the length of each check ring. The check ring 7 is made of a metal pipe, or is made by means of metal die casting, or is made by means of plastic injection molding.

Each trampoline ring part 1 of the present invention may be a square pipe. Correspondingly, the connecting tube 22 and the check ring 7 may be square pipes for fitting.

Each trampoline ring part 1 of the present invention may further be a circular pipe. Freedom of a rotational direction at a sleeve joint of the circular pipe needs to be restricted to maintain the stability of the trampoline. Therefore, the joint 2 generally has a pseudo-elliptical shape, a triangular shape, a quadrangular shape, a pentagonal shape, a hexagonal shape, and the like. Correspondingly, each check ring correspondingly has a pseudo-elliptical shape, a triangular shape, a quadrangular shape, a pentagonal shape, a hexagonal shape, and the like. Certainly, an outer edge of the check ring 7 having each shape may have a circular shape that is consistent with a circular shape of a cross section of the trampoline ring part 1.

Finally, it should be noted that during the adjustment of the present invention, the joint 2 is mainly adjusted to change the relative positions of the adjacent trampoline ring parts 1 (elastic deformation of the trampoline ring parts may be ignored here) to change the size of a trampoline ring (a primary factor). Moreover, because a particular elastic deformation inevitably occurs during adjustment of the trampoline ring parts 1, the size and elasticity of the trampoline ring also changes (a secondary factor). Therefore, an adjustment effect of the trampoline ring of the present invention is achieved by combining the primary factor with the secondary factor.

What is claimed is:

1. A trampoline with adjustable elasticity, wherein the trampoline comprises several corresponding trampoline ring parts, and adjacent trampoline ring parts are connected through a joint to form the trampoline; and an arc length between the adjacent trampoline ring parts changes through adjustment of the joint, and is fixed after relative positions of the two adjacent trampoline ring parts are properly adjusted, wherein:

the joint is T-shaped, and comprises a column and a connecting tube that connects the adjacent trampoline ring parts;

a through hole for a connecting rod to pass through is provided on the column in a transverse direction, and positioning parts that are located on two sides of the through hole and position the connecting rod are provided on the connecting rod; and joint end portions of the adjacent trampoline ring parts extend downwardly to form connecting bases corresponding to the connecting rod, a connecting hole for the connecting rod to pass through is provided on each connecting base, and a position of the connecting rod on the connecting hole is adjustable and fixed.

2. The trampoline with adjustable elasticity according to claim 1, wherein each positioning part has a structural form of a knob, and the positioning part is screwed into the connecting rod, and implements positioning of the connecting rod by using a threaded hole that is provided on the connecting rod and a cross bolt that passes through the knob positioning part.

3. The trampoline with adjustable elasticity according to claim 1, wherein negatively provided external threads are provided at two ends of the connecting rod, and corresponding internal threads are provided at the connecting holes of the connecting bases.

4. The trampoline with adjustable elasticity according to claim 1, wherein the joint comprises a connecting tube corresponding to the trampoline ring parts, and check rings are sleeved over the connecting tube and are positioned by a stepped surface formed on the connecting tube, to change a depth at which the connecting tube enters the trampoline ring parts.

5. The trampoline with adjustable elasticity according to claim 4, wherein the joint has a pseudo-elliptical shape, a triangular shape, a quadrangular shape, a pentagonal shape, or a hexagonal shape, and each check ring correspondingly has a pseudo-elliptical shape, a triangular shape, a quadrangular shape, a pentagonal shape, or a hexagonal shape.

6. The trampoline with adjustable elasticity according to claim 5, wherein an outer edge of the check ring has a circular shape that is consistent with a circular shape of a cross section of the trampoline ring part.

* * * * *